United States Patent [19]

Griffith et al.

[11] Patent Number: 4,759,508

[45] Date of Patent: Jul. 26, 1988

[54] APPARATUS FOR CRUSHING CONTAINERS CONTAINING A TOXIC LIQUID

[75] Inventors: Lorin C. Griffith, West Bend; Mark J. Griffith, Glendale, both of Wis.

[73] Assignee: S & G Enterprises Inc., Milwaukee, Wis.

[21] Appl. No.: 21,164

[22] Filed: Mar. 3, 1987

[51] Int. Cl.[4] ..... B02C 19/14

[52] U.S. Cl. ..... 241/79; 241/99; 241/100; 241/101.3; 241/224; 241/230

[58] Field of Search ..... 241/99, 100, 230–236, 241/101.3, 224, 225, 222, DIG. 14, 79, 24, 98

[56] References Cited

U.S. PATENT DOCUMENTS

| | | | |
|---|---|---|---|
| 3,687,062 | 8/1972 | Frank | 241/99 X |
| 3,750,966 | 8/1973 | Anderson | 241/99 |
| 3,926,379 | 12/1975 | Dryden et al. | 241/69 |
| 4,153,206 | 5/1979 | Haefner et al. | 241/14 |
| 4,655,404 | 4/1987 | Deklerow | 241/99 |

FOREIGN PATENT DOCUMENTS

| | | | |
|---|---|---|---|
| 1257394 | 12/1971 | United Kingdom | 241/99 |

*Primary Examiner*—Mark Rosenbaum

*Attorney, Agent, or Firm*—Andrus, Sceales, Starke & Sawall

[57] ABSTRACT

An apparatus for crushing small containers, such as vials, containing a scintillation liquid. The apparatus includes a closed housing having a feed opening in the upper end which communicates with a hopper. The lower end of the hopper registers with a pair of cooperating crusher rolls, and the vials fed into the hopper flow downwardly through the rolls which crush or rupture the vials to permit the liquid to be expelled. After crushing, the vials and the liquid pass through a chute and are discharged into an end of a closed vibratory conveyor unit that includes at least one vibrating screen. The liquid passes through the screen and is collected in a container while the crushed vials are conveyed along the screen and are discharged into a collection drum. The apparatus includes a loading basket that is pivoted to a carriage which is slidable on tracks mounted on the outer surface of the housing beneath the inlet opening. After being filled with vials, the basket is manually raised to a position adjacent the inlet opening and is then tilted inwardly causing a door which normally encloses the inlet opening, to be swung to an open position to permit the vials to be fed into the hopper. The feeding mechanism enables the vials to be fed to the crushing mechanism while maintaining a substantially sealed condition to prevent pollution of the atmosphere by fumes generated from the separated liquid.

14 Claims, 3 Drawing Sheets

APPARATUS FOR CRUSHING CONTAINERS CONTAINING A TOXIC LIQUID

BACKGROUND OF THE INVENTION

Disposal of medical laboratory vials that contain a scintillation liquid has become a matter of concern since federal regulations on hazardous waste disposal has regulated the disposal of toxic liquids. The restrictions on the disposal of scintillation liquids are caused primarily by the flammability and toxicity of the liquids, such as toluene, xylene, and pseudocumene, rather than the radioactivity of the liquids.

Medical vials containing a scintillation liquid are either formed from glass or plastic and are closed by a plastic threaded cap. In the past, liquid scintillation vials have generally been disposed of through off-site shipment. In this method of disposal, the vials are packed in 55 gallon drums and shipped to disposal sites. As each vial contains only about an average of 10 milliliters of liquid, the drum will only dispose of about 36 liters of liquid. This results in an extremely high cost for disposal as compared to the amount of liquid contained in the drum.

It is not feasible to manually unthread the caps on the vials, empty the liquid, and then separately dispose of the liquid and vials, due to the multitude of vials and the high cost of labor. Moreover, manually opening the vials and emptying the contents can expose the workers to toxic vapors generated by the liquids.

No practical crushing method has been devised to crush the vials and separate the liquid so that the liquid and vials can be separately disposed of, the problem being that plastic vials and caps are exceedingly tough and resilient and, as such, are extremely difficult to crush or tear so that the liquid can be removed. Further, crushing of the vials to separate the liquid can result in a serious air pollution problem due to the generation of vapors or fumes from the liquid.

SUMMARY OF THE INVENTION

The invention is directed to a crushing apparatus having particular application for crushing medical vials containing a liquid, and in particular toxic or scintillation liquid. The apparatus acts to effectively separate the liquid from glass or plastic vials and yet prevents the discharge of noxious fumes or vapors to the atmosphere.

In accordance with the invention, the apparatus is composed of a closed housing having an inlet opening in the upper end which communicates with a hopper. The lower discharge end of the hopper registers with a pair of cooperating crusher rolls and vials fed into the hopper will flow downwardly into the rolls where they are crushed or ruptured to permit the liquid to drain from the vials. The crushed vials and liquid pass downwardly from the crushing rolls through a chute into an end of a closed vibratory conveyor unit having at least one vibratory screen. The liquid passes through the screen and is collected in a container, while the crushed vials are conveyed on the conveyor and are discharged into a collection drum. The vibratory action of the conveyor serves to jostle the crushed vials to effectively remove or drain the liquid from the vials.

The apparatus also includes a unique feeding mechanism in which the vials are fed into the hopper while maintaining a substantially sealed condition in the housing to prevent pollution of the atmosphere by vapors generated through the release of the liquid. The inlet in the housing is closed off by a hinged door and a guide track is mounted on the outer surface of the housing beneath the door. Mounted for movement on the track is a carriage and a loading basket is pivoted to the carriage. Vials are introduced into the basket when the basket is in a lower position on the guide tracks. After filling, the basket is manually moved upwardly along the tracks to a position adjacent the door that encloses the inlet opening to the hopper. The basket is then manually pivoted or tilted inwardly causing the door to open and enabling the vials to be discharged into the hopper. The inlet opening is effectively sealed by the rim of the basket to maintain the sealed characteristics in the housing as the vials are dumped into the hopper.

As a further feature of the invention, the weight of the basket and its contents are partially counterbalanced by a plate which is connected through a pulley and cable arrangement to the carriage. When the basket is in its lower position, the counterbalance plate will be located in front of the door leading to the hopper to prevent the manual opening of the door. In addition, a safety mechanism is incorporated which will normally lock the door in the closed position, but will automatically be released when the basket is moved upwardly to a position adjacent the door.

Other objects and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 4:
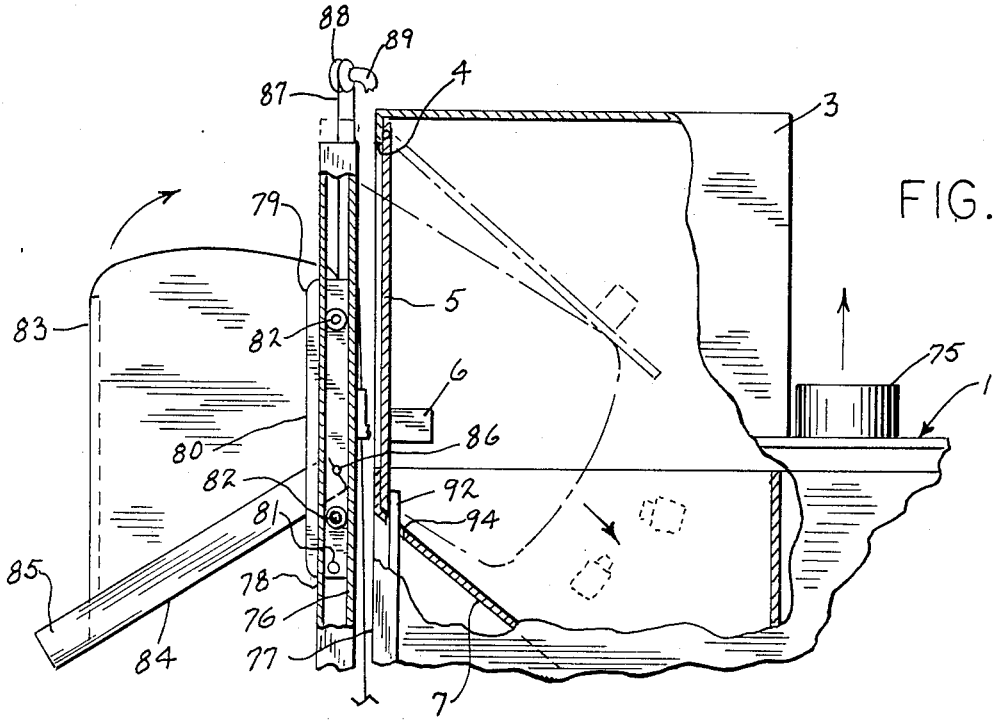
FIG. 4 is a fragmentary end view showing the basket in the upper loading position.

The drawings illustrate an apparatus for crushing articles and in particular medical vials containing a scintillation liquid. The apparatus includes a housing 1 which is supported on a series of legs 2. Housing 1 includes an upper inlet section 3 having an inlet opening 4 which is normally closed by a hinged door 5. A small counterweight 6, shown in FIG. 4, is attached to the inner surface of door 5 and serves to bias or urge the door to a closed position.

Located within housing 1 beneath inlet section 3 is a hopper 7 and the lower end of the hopper communicates with a crushing unit 8.

Crushing unit 8 includes a pair of support bars 9, and a second pair of support bars 10 that extend transversely of bars 9 and rest on frame members 11 of housing 1. A crusher housing 12 is supported on the bars 9 and is provided with an upwardly facing opening 13 which communicates with the lower end of hopper 7. Mounted for rotation in crusher housing 12 is a pair of cooperating crusher rolls 14 and 15 which act to crush the vials falling downwardly from the hopper into the crushing unit.

To drive rolls 14 and 15, a motor 16 is mounted in housing 1 and the output shaft of motor 16 is connected to a gear box or transmission 17, while the output shaft of the gear box is connected by coupling 18 to shaft 19 of roll 14 so that the motor, acting through gear box 17, will directly drive the roll 14.

Figure 5:
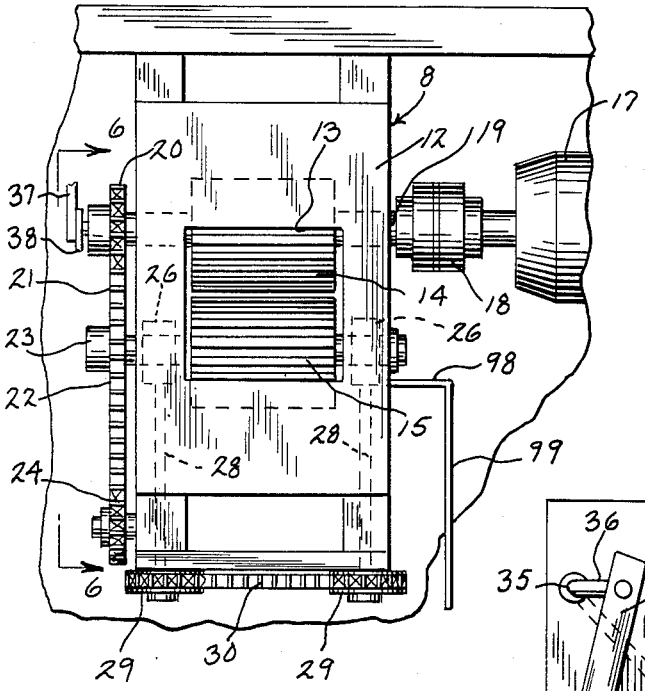
FIG. 5 a view taken along line 5—5 of FIG. 2.
Figure 6:
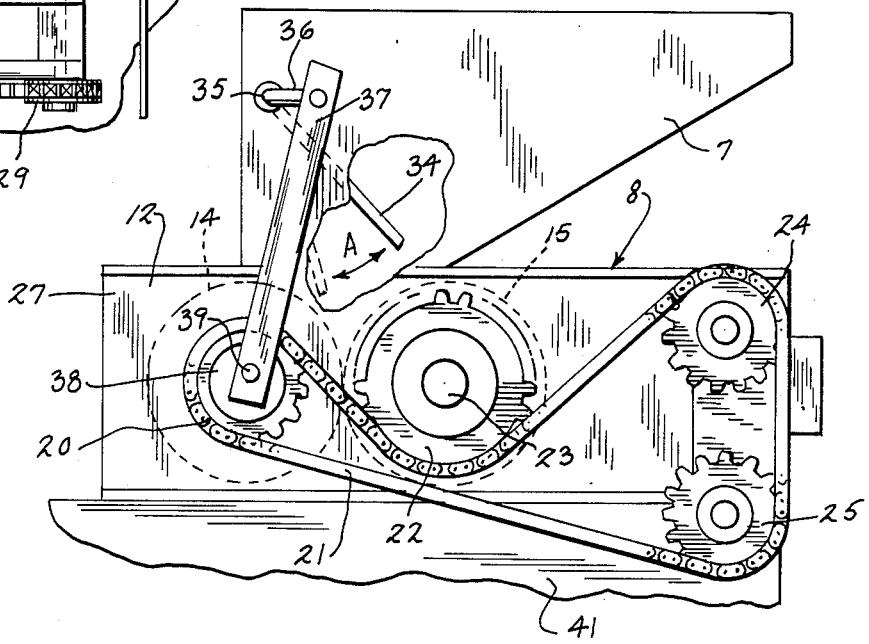
FIG. 6 is a view taken along line 6—6 of FIG. 5.
Figure 7:
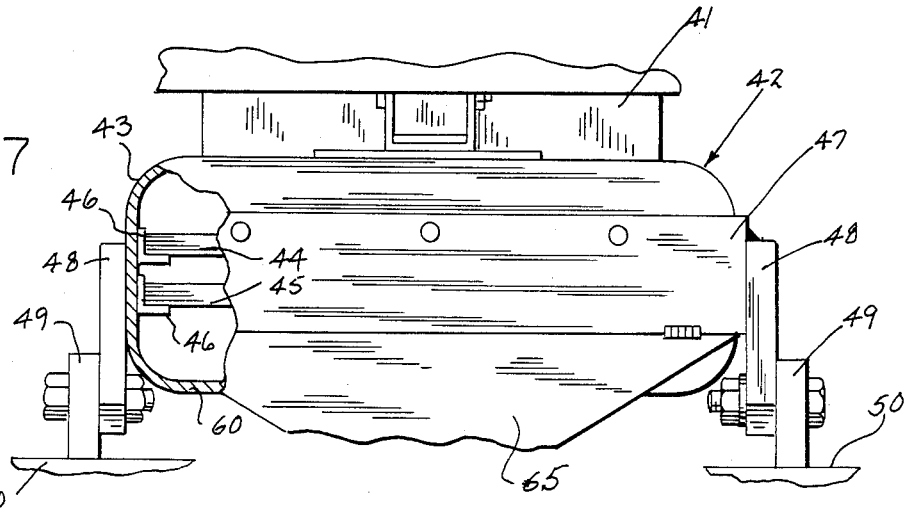
FIG. 7 is a fragmentary end view showing the end of the vibratory conveyor.

As shown in FIG. 5, the opposite end of shaft 19 carriages a sprocket 20, which is connected by chain 21 to a larger sprocket 22 mounted on shaft 23 of roll 15. In addition, chain 21 is also engaged with a pair of idler sprockets 24 and 25 which are mounted on the crusher housing 12. With the chain drive, as illustrated in FIG. 6, roll 15 will be rotated in the opposite direction and at a slower speed than the roll 14. The differential in speed between the rolls aids in ripping or tearing the plastic vials apart to release the liquid.

Figure 1:
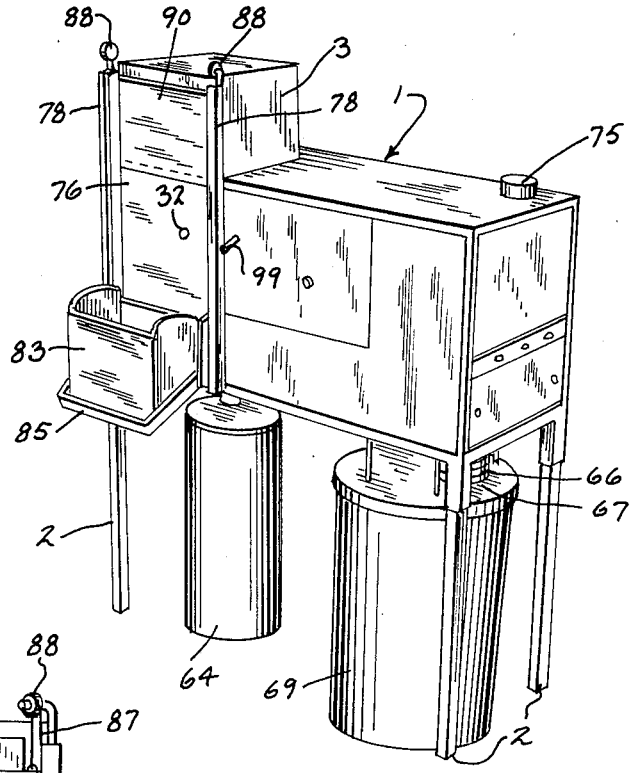
FIG. 1 is a perspective view of the crushing apparatus of the invention.
Figure 2:
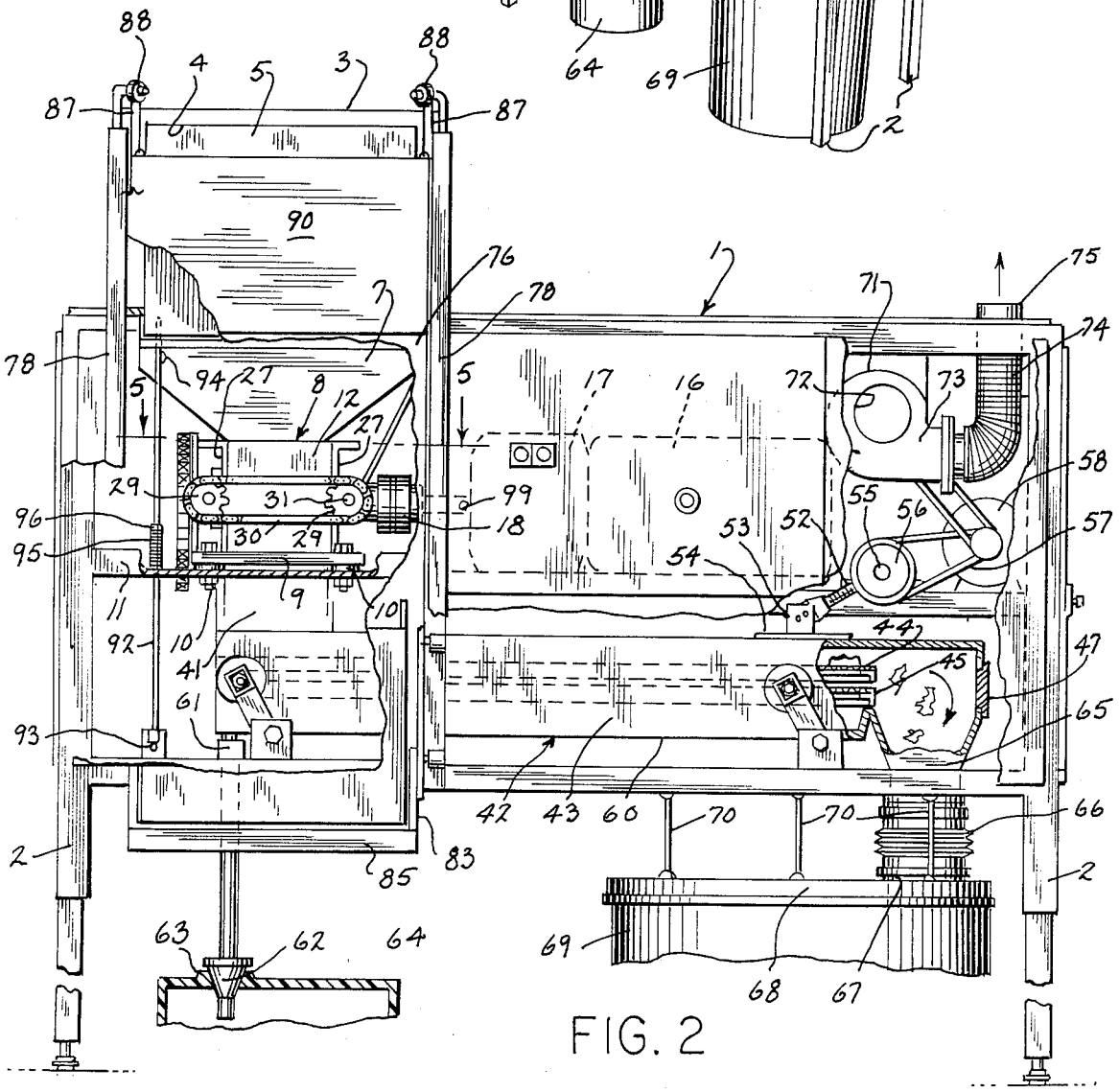
FIG. 2 is a front elevation with parts broken away in section.
Figure 3:
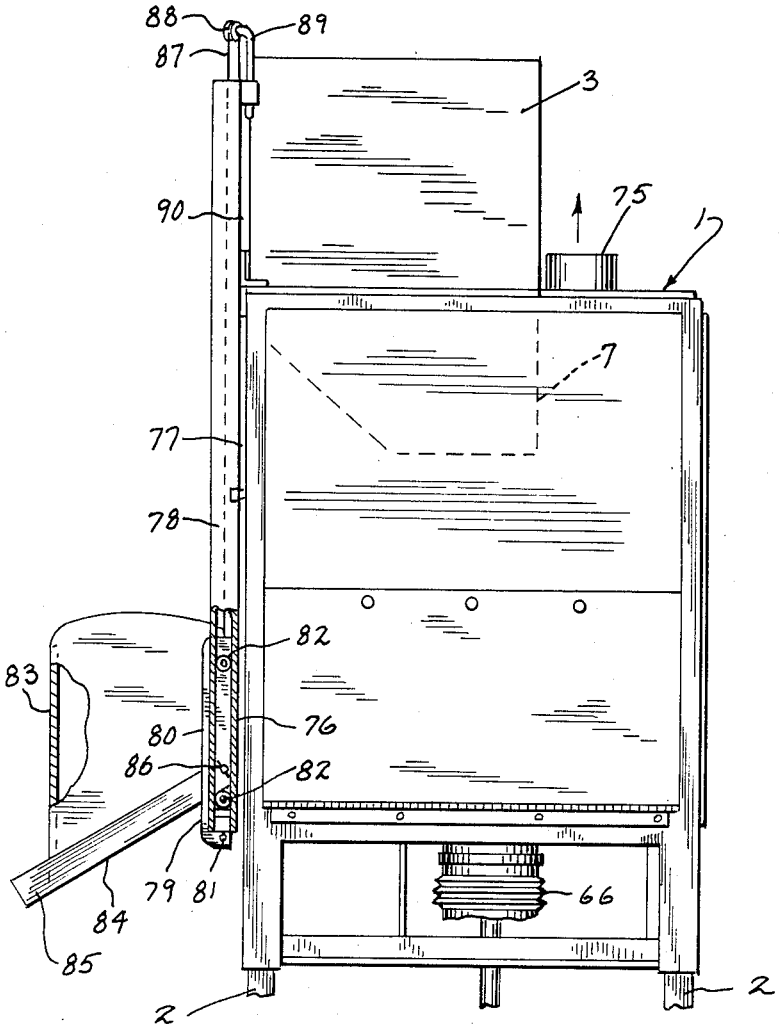
FIG. 3 is an end view of the apparatus with the loading basket being shown in the lower position.

The spacing between rolls 14 and 15 can be adjusted to accommodate the particlar type of vial being crushed. In this regard, roll 15 can be moved in a direction toward and away from roll 14 to regulate the spacing therebetween. To provide this adjustment, the ends of shaft 23 of roll 15 are journalled within bearing blocks 26 which are mounted for sliding movement in guideways formed in the side walls 27 of crusher housing 12. One end of a threaded rod 28 is secured to each bearing block 26 and the opposite end of each rod is threaded in an opening in frame 1 and carries a sprocket 29. Sprockets 29 are connected together by chain 30. As best shown in FIG. 2, the end of the shaft that carries one of the sprockets 29 is provided with a hexagonal opening 31 which can receive a mating tool that can be inserted through a hole 32 in housing 1. The outer end of the tool can be provided with a hand knob or wheel.

By use of the tool 32 chain 30 can be driven to rotate rods 28 that are carried by the respective sprockets 29. Rotation of rods 28, which are threaded within holes in frame 1, will cause the bearing blocks 26 and roll 15 to be moved in a direction toward or away from roll 14 to adjust the spacing therebetween.

To more effectively crush the vials, rolls 14 and 15 are each provided with a plurality of longitudinally extending ribs or corrugations.

To aid in delivering the vials into the nip between rolls 14 and 15 and prevent bridging of the vials, a pair of spaced parallel agitating fingers 34 extend downwardly from hopper 7 into the throat between rolls 14 and 15. The upper ends of fingers 34 are connected to a rod 35 that is journalled in the side walls of hopper 7. One end of rod 35 is provided with a right angle bend 36 which is pivotally connected to the upper end of an arm 37, while the lower end of arm 37 is attached to a disc 38 by a pivot 39. As shown in FIG. 6, the pivotable connection of arm 37 to disc 38 is offset from the axis of rotation of roll 14, so that arm 37 acts as a crank to move rod 35 and fingers 34 in an oscillating path indicated by A in FIG. 6. The oscillating movement of fingers 34 agitates or jostles the vials being fed to rolls 14 and 15 to prevent the vials from bridging over in the lower end of the hopper.

If the vials are made of plastic material, the spacing between crushing rolls 14 and 15 is minimized and the rolls will tend to rip or tear the vials to permit the liquid to escape. On the other hand, if the vials are glass, the crushing rolls 14 and 15 will normally be spaced apart a greater distance and the glass vials will be crushed into small particles or fragments. The crushed vials being discharged from rolls 14 and 15 pass downwardly through a chute 41 which is attached to the lower end of crusher housing 12 and are discharged into one end of a closed vibratory conveyor unit 42. Conveyor unit 42 includes a closed housing 43 and a pair of vibratory screens 44 and 45 are mounted in spaced superimposed relation within housing 43. Each screen 44, 45 is mounted on suitable guide rails 46 that project inwardly from the respect sides of the housing 43. The discharge or downstream end of conveyor unit 42 is provided with a hinged door 47 through which the screens 44, 45 can be installed or removed.

To mount conveyor unit 42 for vibratory movement, a pair of arms 48 are pivotably connected to each side of housing 43, and the lower ends of arms 48 are pivotably connected to lugs 49 that are attached to frame members 50 of housing 1.

To provide vibratory motion for conveyor unit 42, one end of a crank 52 is pivotably connected to lugs 53 which project upwardly from plate 54 mounted on the top surface of housing 43. The other end of crank 52 is eccentrically mounted on a shaft 55 that is journalled in bearings mounted on housing 1. A pulley 56 on shaft 55 is connected through a belt drive 57 to the output shaft of a motor 58. With this drive mechanism, operation of the motor 58 will provide vibratory motion for the conveyor unit 42. The vibratory motion of the screens 44 and 45 will tend to agitate or jostle the crushed vials to aid in releasing all of the liquid from the vials.

When crushing glass vials, the glass will shatter into fragments and fines. The upper screen 44 is coarser than lower screen 45 so that the liquid, as well as the fines from crushing of glass vials, will pass downwardly through the screen 44. The fines will be retained on the lower screen 45 while the liquid will pass through the screen 45 to the bottom surface 60 of the housing 43. Surface 60 slopes toward an outlet tube 61, as best shown in FIG. 2. The lower end of outlet tube 61 is provided with a tapered fitting 62 which is adapted to fit in a bung 63 of container 64. Thus, the liquid separated from the vials will drain freely into the container 64 without discharge of any vapors or fumes to the atmosphere.

Located at the downstream end of conveyor unit 42 is a second outlet 65 which is connected by a flexible, extensible tube 66 to an inlet 67 on cover 68 of drum 69. The crushed vials and fragments will flow along the screens 44 and 45 and will be discharged through outlet 65 into the drum 69 for collection.

Cover 68 is suspended from housing 1 by a series of flexible connectors 70 made of wire, chain or the like. When drum 69 is filled, cover 68 can be removed, and due to the flexible characteristics of tube 66 and connectors 70, the cover can be lifted upwardly from the drum to enable the drum to be removed and be replaced with a fresh drum. Again, use of the flexible tube 66 which is connected to cover 68 prevents the escape of fumes into the atmosphere.

Hopper 7, crushing unit 8 and conveyor unit 42 constitute a closed flow path for the vials, but the flow path is not hermetically sealed, and any fumes resulting from the separation of the scintillation liquid that enter the housing 1 are vented through a duct system. In this connection, a blower 71 is mounted in housing 1 and the inlet 72 of blower 71 communicates with the interior of the housing, while the outlet 73 is connected via a flexible tube 74 to a duct system 75. Operation of blower 71 will create a negative pressure within the housing to discharge toxic fumes through the duct system. Due to the negative pressure in the housing, any leakage of gas will be in a direction from the exterior into the housing to prevent escape of the fumes to the atmosphere.

The apparatus of the invention also includes a feeding mechanism for feeding vials into the hopper 7 which will maintain the relatively sealed condition of the housing 1 during the feeding operation. As shown in FIG. 4, plate 76 is mounted in spaced relation to the front surface 77 of housing 1 and the side edges of plate 76 define guide tracks 78. A carriage 79 is mounted to ride in guide tracks 78 and includes a pair of side bars 80 that are connected together by a crossbar 81. A pair of wheels 82 are mounted for rotation on each of the side bars 80 and ride in the respective guide tracks 78.

An open top loading basket 83 is mounted on carriage 79. In the loading position, basket 83 is located at the lower end of guide tracks 78, and the base 84 of basket 83 extends at a downward angle to the horizontal and is provided with an outwardly projecting peripheral flange 85. Base 84 is pivoted to side bars 80 of carriage 79 by pivots 86.

After basket 83 has been filled with a quantity of vials, an operator will move the basket upwardly along guide tracks 78 until the basket reaches a position adjacent the hinged door 5, as shown in FIG. 4. The operator then tilts or pushes the basket inwardly, between side bars 80, causing the basket to engage and pivot door 5 to an open condition as shown by the dashed lines in FIG. 4. With the basket pivoted inwardly into the upper inlet section 3, the vials contained within the basket will flow into the hopper 7. In this feeding position, flange 85 will engage the wall of inlet section 3 bordering opening 4 to effectively seal off the opening and prevent escape of any fumes to the atmosphere.

To aid in lifting the basket 83, a counterbalancing mechanism is incorporated. In this regard, a pair of cables 87 are connected to the upper ends of side bars 80 of carriage 79, and each cable 87 passes over a pulley 88 which is mounted to a leg 89 that extends upwardly from the upper end of plate 76. A counterweight in the form of a plate 90 is attached to the opposite ends of cables 87 and is adapted to slide within the space between plate 76 and front surface 77 of housing 1. When the basket 83 is in its lower loading position, plate 90 will be in its upper position in front of the hinged door 5 to prevent access to the door. Thus, the plate 90 not only serves as a counterweight, but also as a safety guard to prevent opening of door 5.

In addition, a safety mechanism can be incorporated with the apparatus to lock the door 5 in the closed position to prevent opening of the door except during periods when the basket is in its upper feeding position. The safety mechanism can take the form of a rod 92 which is mounted to one of the frame members of housing 1, and rod 92 is provided with a lower bent end 93 which is located in the path of movement of the counterbalancing plate 90. As shown in FIGS. 2 and 4, the upper end of rod 92 extends through a hole 94 in hopper 7 and is positioned behind the lower edge of door 5 to prevent the door from being swung inwardly to an open position. Spring 95 surrounds the central portion of rod 92 and is seated between the frame member 11 and seat 96. The force of spring 95 urges the rod upwardly to the locking position.

As basket 83 is moved upwardly, the counterbalancing plate 90 is correspondingly moved downwardly, and when the plate approaches its lowermost position, the lower edge of the plate will engage the bent end 93 of rod 92, forcing rod 92 downwardly against the force of spring 95 to move the upper end of the rod from the locking position to a release position where it will not interfere with inward swinging movement of door 5. After the loading has been completed and the plate 90 moves upwardly on lowering of basket 83, the force of spring 95 will return the rod 92 to the locking position so that the door 5 cannot be opened.

To provide a visual indication of the spacing of rolls 14 and 15, one end of a generally L-shaped rod 98 is connected to one of the bearing blocks 26, as shown in FIG. 5, while the opposite end 99 of rod 98 projects through a hole in the front wall 77 of housing 1. As bearing blocks 26 and roll 15 are moved toward and away from the roll 14, projecting end 99 of rod 98 will correspondingly be moved relative to the front wall 77 of the housing and a suitable scale can be associated with the projecting end 99 which will indicate the spacing between the rolls 14 and 15 to an operator.

The apparatus of the invention effectively crushes vials containing a liquid and separates the liquid from the crushed vials for separate collection. In addition, the apparatus is a substantially sealed unit which prevents escape of toxic fumes into the atmosphere during the loading, crushing and discharging operations.

Various modes of carrying out the invention are contemplated as being within the scope of the following claims particularly pointing out and distinctly claiming the subject matter which is regarded as the invention.

We claim:

1. An apparatus for crushing articles containing a fluid, comprising a hopper for receiving said articles, an outer enclosure, a pair of cooperating crushing rolls disposed in the outer enclosure and communicating with the lower end of the hopper for crushing the articles and separating the fluid from said articles, drive means for driving said rolls, conveyor means disposed in the outer enclosure and including a closed liquid-impervious housing having an inlet to receive said crushed articles and said liquid being discharged from said rolls, said conveyor means also including a vibratory screen having a downstream end, said articles being conveyed on said screen and said liquid passing through said screen, first outlet means in the lower portion of said housing for discharging said liquid, second outlet means located adjacent said downstream end for discharging said crushed articles, first collection means connected to said first outlet means to collect said liquid, second collection means associated with said second outlet means to collect said crushed articles, means for supporting said closed housing for vibratory movement, and vibratory means operably connected to said housing for vibrating said housing and said screen.

2. The apparatus of claim 1, and including a pair of screens disposed within said housing in superimposed spaced relation, the upper screen of said pair being coarser than the lower screen of said pair.

3. The apparatus of claim 1, wherein each of said rolls is provided with a plurality of generally parallel longitudinal ribs.

4. The apparatus of claim 1, and including means for adjusting the spacing between said rolls.

5. The apparatus of claim 4 and including indicator means operably connected to at least one of said rolls and extending to the outside of said enclosure for visually indicating the spacing between said rolls.

6. The apparatus of claim 1, and including agitator means disposed in said hopper above said rolls for agitating the articles being fed to said rolls.

7. The apparatus of claim 6, wherein said agitating means comprises at least one elongated finger, and means for oscillating said finger in a direction generally normal to the axes of said rolls.

8. An apparatus for crushing articles containing a fluid, comprising a hopper for receiving said articles, a pair of cooperating crushing rolls communicating with the lower end of the hopper for crushing the articles and separating the fluid from said articles, drive means for driving said rolls, conveyor means including a closed housing having an inlet to receive said crushed articles and said liquid being discharged from said rolls, said conveyor means also including a vibratory screen having a downstream end, said articles being conveyed on said screen and said liquid passing through said screen, first outlet means in the lower portion of said housing for discharging said liquid, second outlet means located adjacent said downstream end for discharging said crushed articles, first collection means connected to said first outlet means to collect said liquid, second collection means associated with said second outlet means to collect said crushed articles, said second collection means comprising a container, and a lid for said container, said second outlet means including a longitudinally extensible tube connected to an opening in said lid, said extensible tube permitting said lid to be removed from said container while maintaining the connection between said outlet and said lid.

9. An apparatus for crushing vials containing a toxic liquid, comprising an outer enclosure having an inlet opening, a crushing means disposed within the enclosure and communicating with said inlet opening, said crushing means being constructed and arranged to crush vials being introduced through said inlet opening and release the liquid from the crushed vials, conveyor means located beneath said crushing means rolls for receiving the crushed vials and the liquid, said conveying means including a liquid-permeable conveying member constructed and arranged to separate the liquid from said crushed vials, a door to close the inlet opening and movable between a closed position and an open position, vertical guide means mounted on the outer surface of said enclosure, a carriage mounted for vertical movement on said guide means, and a basket to receive said vials and pivotably connected to said carriage, said basket being movable with said carriage on said guide means from a lower vial loading position to an upper feeding position, said basket being constructed and arranged to be pivoted inwardly when said basket is in the upper position to engage and open said door and dump said vials through said inlet opening, said basket having a size and shape sufficient to seal off said inlet opening when said basket is in the upper position to substantially prevent escape of vapors from the enclosure to the atmosphere.

10. The apparatus of claim 9, and including a counterweight operably connected to the basket for partially counterbalancing the weight of said basket and said vials.

11. The apparatus of claim 10, wherein said counterweight comprises a plate, said plate being disposed across said inlet opening when said basket is in the lower loading position to prevent opening of said closure and said plate being disposed out of registry with said inlet opening when said basket is in the upper feeding position.

12. The apparatus of claim 11, wherein said guide means is spaced outwardly of said enclosure to provide a space therebetween, and said plate is movable within said space.

13. The apparatus of claim 9, and including locking means for locking the closure in the closed position when the basket is in the lower loading position, and means operable as a consequence of said basket being moved toward said feeding position to release said locking means.

14. An apparatus for crushing vials containing a toxic liquid, comprising an outer enclosure having an inlet opening, crushing means disposed within the enclosure and communicating with said inlet opening, said crushing means being constructed and arranged to crush vials being introduced through said inlet opening and release the liquid from the crushed vials, conveyor means located beneath said crushing means for receiving the crushed vials and the liquid, said conveying means including a permeable conveying member constructed and arranged to separate the liquid from said crushed vials, a door to close the inlet opening and movable between a closed position and an open position, vertical guide means mounted on the outer surface of said enclosure, a basket to receive the vials and mounted for vertical movement on said guide means between a lower loading position and an upper feeding position, a counterweight operably connected to the basket for partially counterbalancing the weight of said basket and said vials contained therein, said counterweight being disposed in registry with said inlet opening when said basket is in the lower loading position to prevent opening of said door, and said counterweight being disposed out of registry with said inlet opening when said basket is in the upper feeding position.

* * * * *

UNITED STATES PATENT AND TRADEMARK OFFICE

CERTIFICATE OF CORRECTION

PATENT NO. : 4,759,508

DATED : July 26, 1988

INVENTOR(S) : LORIN C. GRIFFITH, ET AL

It is certified that error appears in the above-identified patent and that said Letters Patent is hereby corrected as shown below:

| | |
|---|---|
| Col. 7, Line 4, CLAIM 7 | Delete "agitating" and substitute therefor ---agitator--- |
| Col. 8, Line 22, CLAIM 13 | Delete "closure" and substitute therefor ---door--- |

Signed and Sealed this

Twenty-fourth Day of October, 1989

*Attest:*

DONALD J. QUIGG

*Attesting Officer*

*Commissioner of Patents and Trademarks*